US007921683B2

(12) United States Patent
Largay, Jr.

(10) Patent No.: US 7,921,683 B2
(45) Date of Patent: Apr. 12, 2011

(54) LOCKING CONTAINER

(76) Inventor: Charles E. Largay, Jr., Pembroke Pines, FL (US)

( * ) Notice: Subject to any disclaimer, the term of this patent is extended or adjusted under 35 U.S.C. 154(b) by 294 days.

(21) Appl. No.: 12/379,879

(22) Filed: Mar. 4, 2009

(65) Prior Publication Data

US 2010/0223964 A1 Sep. 9, 2010

(51) Int. Cl.
*B65D 55/14* (2006.01)
*E05B 67/38* (2006.01)

(52) U.S. Cl. ..... 70/56; 70/63; 70/158; 70/159; 70/164; 70/DIG. 63; 220/370; 220/372; 312/210

(58) Field of Classification Search ..... 70/158–162, 70/164, 63, 54–56, DIG. 43, DIG. 56, 417, 70/2, DIG. 63, DIG. 34; 220/370, 372; 312/210
See application file for complete search history.

(56) References Cited

U.S. PATENT DOCUMENTS

| | | | | | |
|---|---|---|---|---|---|
| 246,503 | A * | 8/1881 | Haslett | 70/159 |
| 1,894,159 | A * | 1/1933 | Clark et al. | 209/42 |
| 1,983,716 | A * | 12/1934 | Vidal | 109/52 |
| 3,157,040 | A * | 11/1964 | Raye | 70/57 |
| 3,372,995 | A * | 3/1968 | Ryan | 422/261 |
| 3,727,438 | A * | 4/1973 | Knaack | 70/63 |
| 3,838,586 | A * | 10/1974 | Tennison | 70/56 |
| 4,288,134 | A * | 9/1981 | Knaack et al. | 312/290 |
| 5,076,078 | A * | 12/1991 | Weger, Jr. | 70/54 |
| 5,235,830 | A * | 8/1993 | Benge | 70/56 |
| 5,484,092 | A * | 1/1996 | Cheney | 224/404 |
| 5,683,126 | A | 11/1997 | De Vivo et al. | |
| 5,730,009 | A * | 3/1998 | Westfield | 70/63 |
| 6,047,573 | A * | 4/2000 | Martinez | 70/58 |
| 6,327,878 | B1 | 12/2001 | Levenson | |
| 6,772,613 | B2 * | 8/2004 | Webb et al. | 70/159 |
| 7,418,846 | B2 * | 9/2008 | James et al. | 70/159 |
| 2004/0139771 | A1 | 7/2004 | Wyers | |
| 2004/0211230 | A1 | 10/2004 | Recknagel et al. | |
| 2009/0277905 | A1 * | 11/2009 | Gillan | 220/315 |
| 2010/0223966 | A1 * | 9/2010 | Ennis et al. | 70/159 |

* cited by examiner

*Primary Examiner* — Lloyd A Gall
(74) *Attorney, Agent, or Firm* — Richard C. Litman

(57) ABSTRACT

The locking container is a selectively lockable container for the storage of used cooking oil and the like. The locking container includes a reservoir and both front and side locking mechanisms. The front and side locking mechanisms selectively retain a screen within the reservoir. The container is adapted for the disposal of oils, solvents, acids and various other liquid wastes. The pair of locking mechanisms allow access for storing the liquid waste in the container, but prevent unauthorized removal of the liquid waste. The container includes a lid to cover the screen, with the lid being secured by the front locking mechanism. The side locking mechanism locks the screen to the reservoir.

20 Claims, 4 Drawing Sheets

LOCKING CONTAINER

BACKGROUND OF THE INVENTION

1. Field of the Invention

The present invention relates to locking storage receptacles. Particularly, the present invention relates to a locking container having a screen, the container being adapted for holding contaminated oils or other such liquids.

2. Description of the Related Art

Over the past two decades, there has been growing concern with regard to the disposal of waste materials of various types. There has been particular concern raised with respect to the disposal of oils, solvents, acids and various other liquid wastes. Recent federal and state legislation has mandated the recycling of both solid and liquid wastes, and further imposing restrictions upon the types of wastes, which may be stored in landfills.

In the recent past, containers or drums of used French fry and other fast food-type grease were only of interest to a small network of bio-fuel brewers, who would use the oil to power diesel-fueled automobiles. However, the price of the cooking oil, which can be converted into bio-fuel and used to power the engines, has skyrocketed almost 400 percent since 2000. Restaurants that once paid to have the used grease disposed of are now being paid almost $200 for one tank of used grease. "Green" business owners, who are interested in the recycling of their used grease, however, are now experiencing the problem of theft of their grease, presumably for usage in the production of biodiesel fuel by outside parties.

Restaurants have begun reporting thefts of used cooking oil worth thousands of dollars. Losses at one site alone have cost a company $3,700 in lost oil revenues in the last year. The containers for storing the waste liquid typically have screens, allowing the restaurant owners or others disposing of the liquid to lift the container lid and pour the grease through the filtering screens to be stored in the containers. However, without additional deterrents, thieves often arrive with a pumping truck and hose and pump the oil out of the special dumpsters and containers. The lid of the container is lifted and the screen is simply moved aside. Although, conventional padlocks and the like are well known in the art of securing dumpster lids, such locks are typically not tamper-resistant and can be easily cut from the container. Thus, a locking container solving the aforementioned problems is desired.

SUMMARY OF THE INVENTION

The locking container is a selectively lockable container for the storage of used cooking oil and the like. The locking container includes a reservoir having a lower wall and at least one sidewall having an upper edge. The reservoir defines an open interior region for receiving used cooking oil or the like. A raised, substantially C-shaped sidewall is mounted on the upper edge of the at least one sidewall of the reservoir. The raised, substantially C-shaped sidewall defines an open front aligned with a front, upper edge of the at least one sidewall of the reservoir.

A lid is pivotally attached to the C-shaped sidewall by hinges or the like in order to selectively cover an open upper end and the open front thereof. A screen is removably received within the reservoir, and a side locking mechanism is provided for locking the screen within the reservoir.

The side locking mechanism is attached to the C-shaped sidewall. The side locking mechanism includes a cover attached to an exterior face of the C-shaped sidewall. The cover defines an open interior region for receiving a side locking member. The cover preferably has an open front end. The side locking member has a side passage formed therethrough for slidably receiving a side hitch-pin. The side locking member further includes a side lock for selectively and releasably engaging the side hitch-pin when the side hitch-pin is received within the side passage.

A hasp is secured to the screen at one end thereof, and a free end of the hasp is selectively and releasably locked to the side locking mechanism. The side hitch-pin engages the side locking member and the free end of the hasp. A front locking mechanism is further provided. The front locking mechanism includes a cover portion attached to a front edge of the lid. The cover portion defines an open interior region for receiving a front hitch-pin.

The front locking mechanism has a front locking member attached to the at least one sidewall adjacent the front, upper edge of the sidewall. The front locking member has a front passage formed therethrough for slidably receiving the front hitch-pin. The front locking member has a front lock for selectively and releasably engaging the front hitch-pin when the front hitch-pin is received within the front passage.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
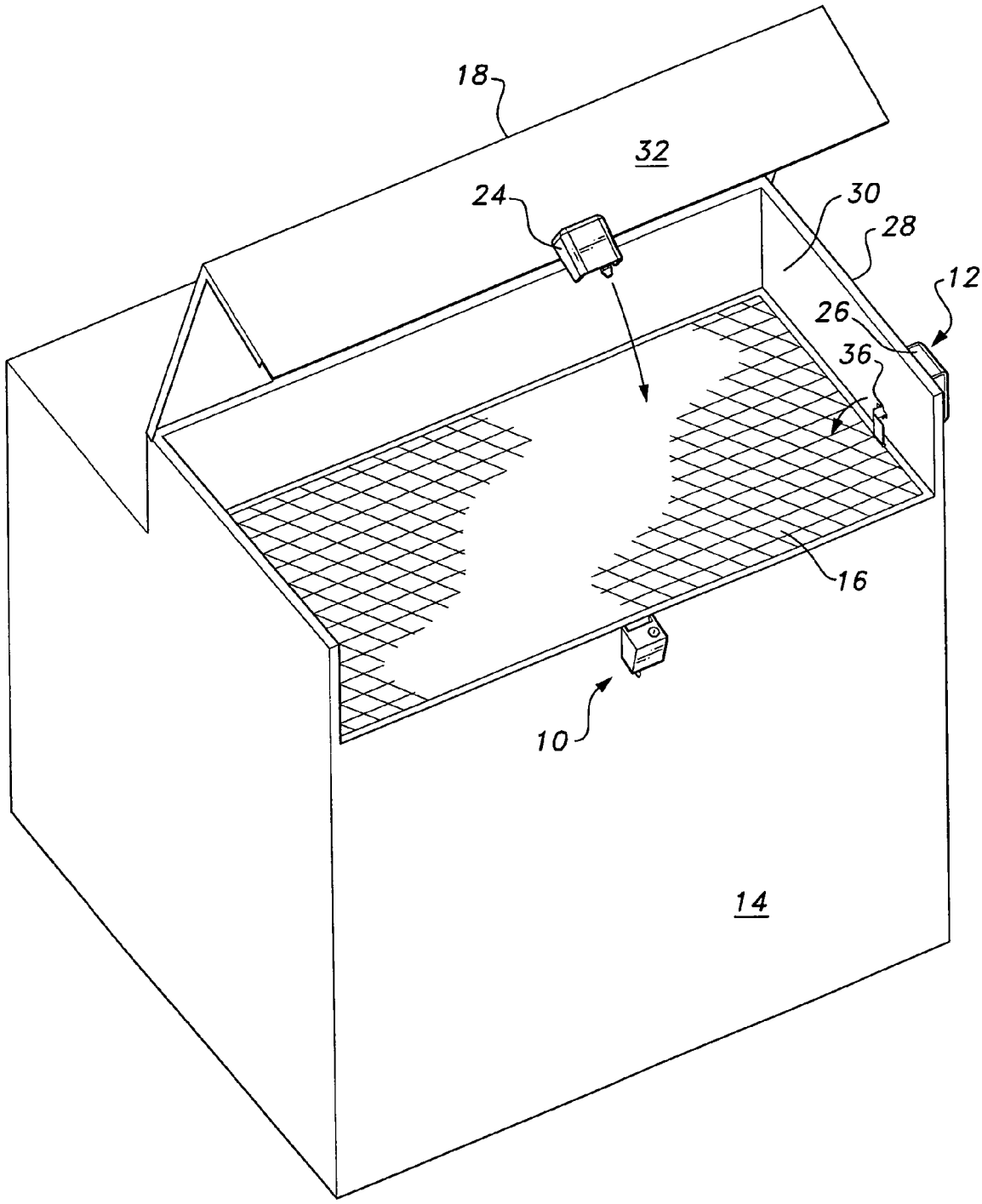
FIG. 1 is a perspective view of a locking container according to the present invention.
Figure 2:
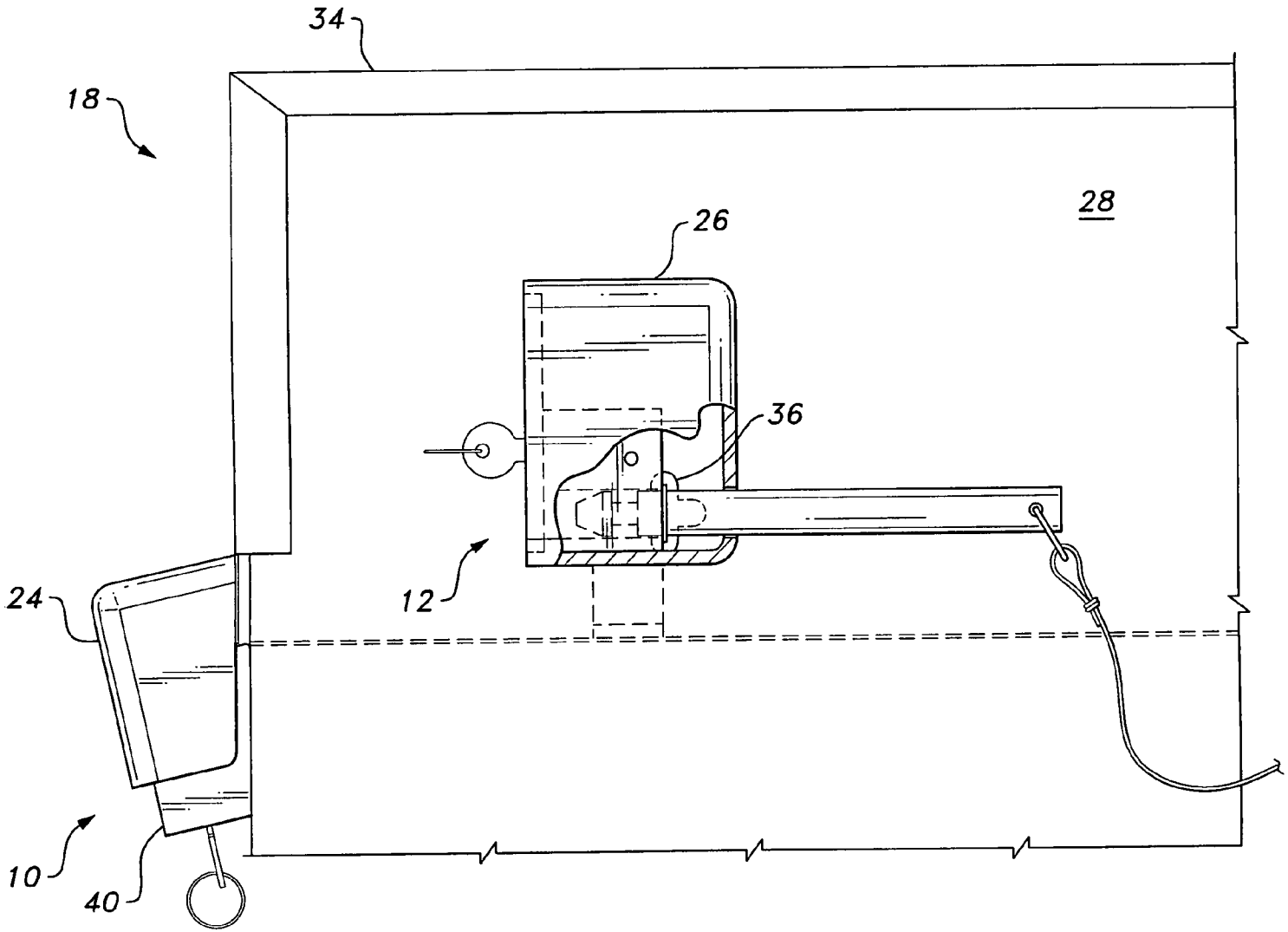
FIG. 2 is a side view of the locking container according to the present invention, broken away and partially in section.

Referring to FIGS. 1 and 2, the locking container includes a pair of locking mechanisms 10, 12 for use with a reservoir or main container body 14. A front locking mechanism 10 is used to lock the front of the reservoir 14, and a side locking mechanism 12 is used for locking the side of the reservoir 14. The locking mechanisms 10, 12 are adapted for locking a reservoir 14 having a covering screen 16 and a hinged lid 18.

It should be understood that the size, shape and relative dimensions of reservoir 14 (and the screen 16 and lid 18 thereof) shown in the drawings are for exemplary purposes only. The overall locking container includes a reservoir 14, which defines an open interior region for receiving used cooking oil or the like. Reservoir 14 includes a lower wall and at least one sidewall having an upper edge, as shown.

The hinged lid 18 has a portion of the front lock mechanism 10 attached thereto in the form of a cover 24. The base of the reservoir 14, in front of the screen 16, receives the front lock mechanism 10. The side lock mechanism 12 is used to secure the screen 16. In conventional storage containers, such as reservoir 14, screens, such as screen 16, sit upon an internal shelf that allows truck drivers or other operators to push the screen 16 back and out of the way to retrieve the waste oil within using a hose and a pump.

The side lock mechanism 12 includes a box cover 26, which is attached to an exterior face of a raised sidewall 28 of the reservoir 14, through welding or the like. The raised sidewall 28 extends around the reservoir 14, forming a three-sided, substantially C-shaped enclosure 30 around the screen 16. The lid 18 includes a front portion 32, a top portion 34, and a rear portion. The laterally opposed sides of the lid 18 are open so that when the lid 18 is closed, lid 18 and the enclosure 30 completely cover the screen 16. The C-shaped, raised sidewall 28 and lid 18 may only cover the front portion of the container. As will be described in detail below, the purpose of the C-shaped, raised sidewall 28 and lid 18 is to-prevent access to an internal locking mechanism for the screen 16. The raised, substantially C-shaped sidewall 28 is mounted on the upper edge of the at least one sidewall of the reservoir 14, or is formed laterally by extensions of the reservoir sidewall, which are joined by a rear wall that rises upward from a top wall of the container. The raised, substantially C-shaped sidewall 28 defines an open front aligned with a front, upper edge of the at least one sidewall of the reservoir 14. The lid 18 is pivotally attached to the raised, substantially C-shaped sidewall 28 by hinges or the like in order to selectively cover the open top and front of the C-shaped sidewall.

A slot or opening 36 is formed through the raised sidewall 28. A hasp 38 is welded to the screen 16. The hasp 38 extends through the opening 36 to position an eye of the hasp 38 in the center area of the box cover 26. When the hasp 38 extends through the slot 36, the screen 16 cannot be raised far enough to quickly suction or siphon the contents of the reservoir through a large diameter hose. The bar of a lock may be selectively inserted through the eye of the hasp 38, and the box cover 26 of side locking mechanism 12 prevents tampering with the hasp 38.

Figure 3:
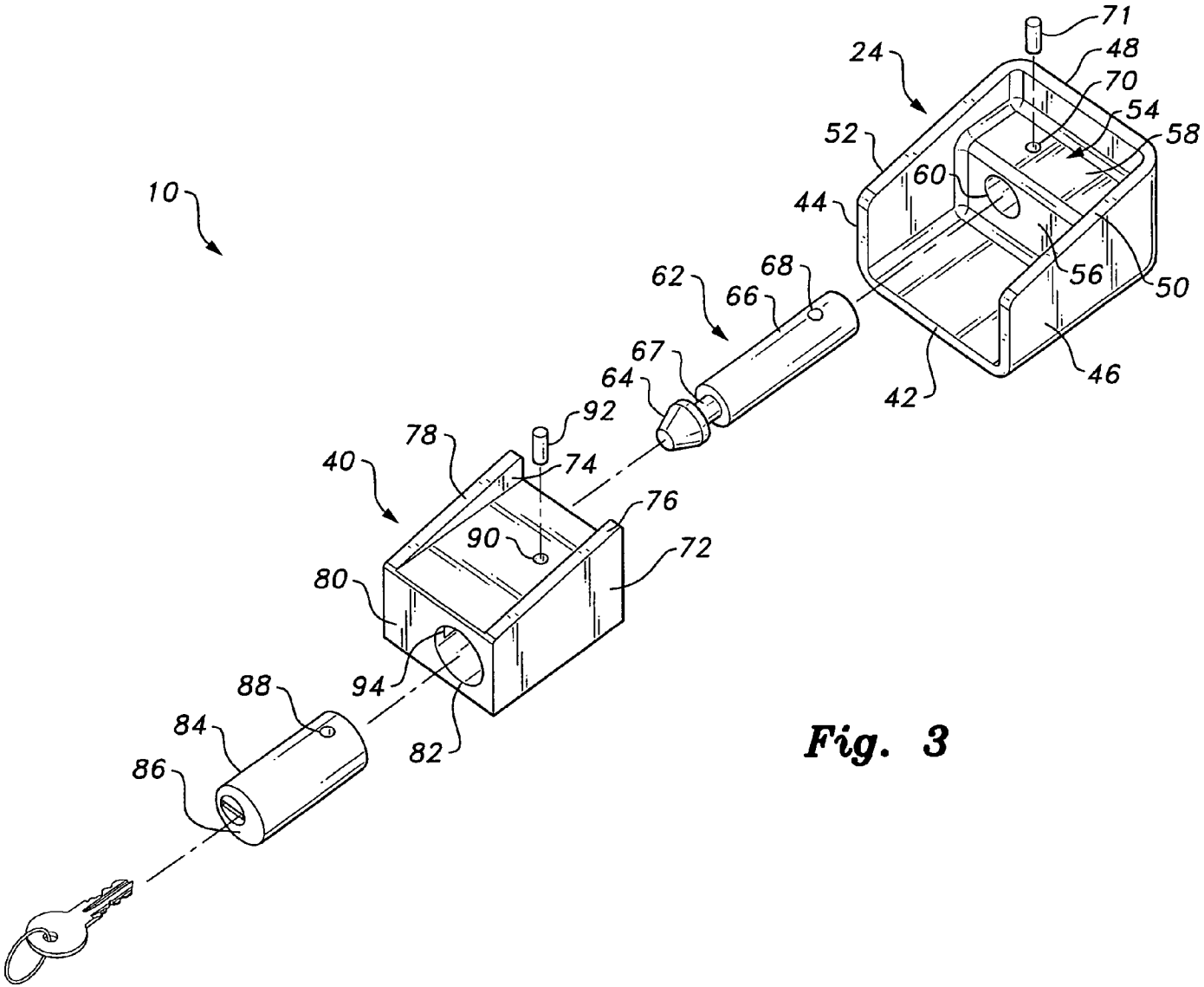
FIG. 3 is an exploded perspective view of a front lock mechanism of the locking container according to the present invention, shown with the front face of the mechanism facing downward in order to view the lock mechanism from the rear.

FIG. 3 illustrates the front locking mechanism 10. The front locking mechanism 10 includes both a front cover 24 and a locking member 40. The front cover 24 releasably covers the locking member 40. The front cover 24 includes a front face 42, a pair of sidewalls 44, 46, and an upper portion 48. The front cover 24 has an open rear that extends from the upper portion 48 to the bottom edges of the sidewalls 44, 46, and an open bottom for receiving the locking member 40. The two sidewalls 44, 46 preferably have matching angled or sloping edges 50, 52. The sloping edges 50, 52 extend the length of the front face 42.

A locking pin holder 54 is disposed inside the front cover 24. The locking pin holder 54 has two exposed faces 56, 58. Face 56 is orthogonal to front face 42, and face 58 is orthogonal to upper portion 48. Face 56 has a hitch-pin hole 60 formed therethrough for receiving a hitch pin 62. The hitch-pin 62 preferably has a substantially conically shaped head 64 which may either take the form of a full cone, or of the frustum of a cone, and a cylindrical body 66. A rod 67 extends between the body 66 and the head 64. The rod 67 is smaller in diameter than the body 66 and the base of the conically shaped head 64, thus forming an annular groove or depression between the body 66 and the head 64.

The body 66 has a pin locking hole 68 formed transversely through the body 66 adjacent the end opposite the head 64. The hitch pin 62 is inserted in the hitch pin hole 60 in the locking pin holder 54, and the pin locking hole 68 of body 66 is aligned with a locking hole 70 formed through face 58 of the locking pin holder 54. A lock pin 71 is fed through the two holes 70, 68 to secure the hitch pin 62 in the locking pin holder 54.

The locking member 40 fits inside lock cover 24 when the lid 18 is closed on the reservoir 14. The locking member 40 has a pair of sidewalls 72, 74 having sloping edges 76, 78 corresponding to the edges 50, 52 of cover 24. The locking member 40 has a bore 82 defined therein that opens at the bottom face 80 of the locking member 40. A cylindrical tumbler lock 84 extends into the bore 82. The tumbler lock 84 has a key end 86 that is exposed for inserting a key to unlock the tumbler lock 84. It should be understood that the cylindrical tumbler lock 84 shown in FIG. 3 is shown for exemplary purposes only. Further, it should be understood that the orientation of locking member 40 and cover 24 may be reversed; i.e., that the locking member 40 may be mounted on wall 32 (as shown in FIG. 1), and cover 24 may be mounted on wall 14.

The tumbler lock 84 has a tumbler locking hole 88 extending transversely into its shell opposite the key end 86. The tumbler locking hole 88 of the tumbler lock 84 aligns with a locking hole 90 formed through the inside face of the locking member 40. A pin 92 is inserted through the two aligned holes 90, 88 to secure the tumbler lock 84 in the locking member 40. The locking member 40 has a second bore 94 defined therein parallel to the bore 82 that opens at the upper face of the locking member 40. The two bores 82 and 84 are connected by a hole or slot. The tumbler lock 84 has a spring-biased latch pin extending therefrom through the hole of slot extending between the two bores 82, 94. When the locking member 40 is inserted into the cover 24, the head 64 of hitch pin 62 depresses the latch pin until the groove 67 is aligned with the latch pin, which extends into the groove 67 because of the spring bias, locking the locking member 40 to the cover 24, and hence the lid 18 to the reservoir. The key may be used to retract the latch pin from the groove 67, thereby permitting the lid 18 to be raised.

As shown in FIGS. 2 and 3, the front box cover edges 50, 52 and the locking member edges 76, 78 are preferably formed with an angle so that the front locking mechanism 10 can be used on the reservoir 14. The container lid 18 has hinges above and behind the front of the reservoir 14. The angle of the front box cover edges 50, 52 and the locking member edges 76, 78 abut the reservoir 14 and the lid 18, allowing the locking member 40 and the hitch pin 62 to connect correctly and properly align. Without the slope of the front box cover edges 50, 52 and the locking member edges 76, 78 of the front lock mechanism 10, the cover 24 and the locking member 40 would not align properly.

Figure 4:
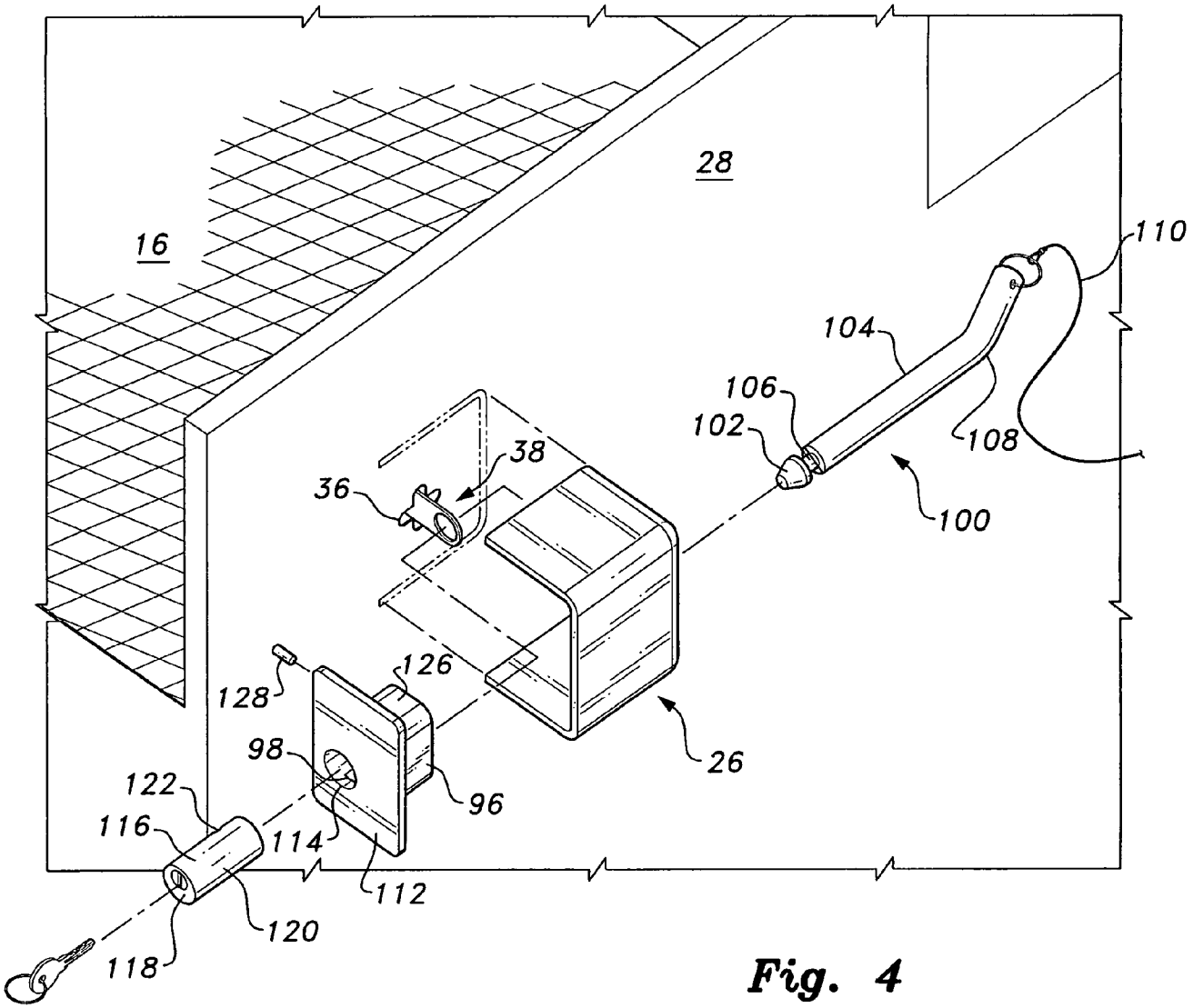
FIG. 4 is an exploded perspective view of a side lock-mechanism for the locking container according to the present invention.

FIG. 4 illustrates the side lock mechanism 12. The side lock mechanism 12 includes a substantially rectangular, box-shaped body 96 having a first bore 98 formed therethrough for receiving a side hitch-pin 100. The side hitch-pin 100 has a substantially conically shaped head 102 and a cylindrical body 104, with a side rod 106 mounted therebetween, similar to that described above with regard to hitch-pin 62. Formed opposite the head 102, the cylindrical body 104 curves or slightly bends to form an elbow bend 108. A chain 110 is preferably attached to the opposite end of elbow bend 108. The elbow bend 108 allows the side hitch-pin 100 to extend outwardly from the reservoir 14, for ease in handling and use. The chain 110 is secured to the reservoir 14 through welding or the like.

Chain 110 acts as a tether for the side hitch-pin 100. When the hitch-pin 100 is not engaged with body 96, the chain 110 prevents hitch-pin 100 from being lost or misplaced. As shown, body 96 of the side lock mechanism 12 has a rectangular front face 112 that extends outward from the body 96, allowing body 96 to be mounted or welded to the raised sidewall 28 of reservoir 14 to cover the front opening in the side lock box 26. The front face 112 and body 96 have a second bore 114 defined therein that extends parallel to first bore 98 and communicates therewith through a slot, the second bore 114 receiving a side tubular tumbler lock 116. The lock 116 includes a key end 118 that is exposed for receiving a key, similar to that described above with reference to tumbler lock 84.

The opposed end 120 of side tumbler lock 116 has a side tumbler locking hole 122 formed transversely therein. The side tumbler lock 116 is received in the tubular aperture 114 formed in the body 96. The side tumbler locking hole 122 aligns with a body locking hole formed through a wall 126 of the body 96. Once the side tumbler lock 116 mates with tumbler aperture 114, and the tumbler locking hole 122 is aligned with the body locking hole, a body securing pin 128 is fed through the aligned holes to secure the side tumbler lock 116 in the body 96.

Similar to that described above with regard to FIG. 3, lock 116 has a spring-biased latch pin that extends through the slot from second bore 114 into first bore 98. When hitch pin 100 is inserted through hasp 38, which extends through slit 36 in raised sidewall 28, and into first bore 98, the conical head 102 depresses the latch pin of lock 116 back into the body of the lock 116 until the latch pin is aligned with the groove defined by rod 106 behind head 102, when the spring bias pushes the latch pin into the groove to prevent forward or rearward movement of hitch pin 100. The lock 116 is released using the key, which retracts the latch pin so that hitch pin 100 may be withdrawn. Side lock box 26 prevents tampering with the side lock mechanism 12, thus locking the screen 16.

It should be noted that the front lock mechanism 10 can be alternatively formed so that the angled edges 50, 52, 76, 78 have ears or tabs extending therefrom, with respective bolt holes formed therethrough. The angled edges 50, 52, 76, 78 can then be attached with stove bolts or other types of fasteners. Once, the front lock mechanism 10 is attached to the reservoir 14 and the lid 18 is closed, the front lock mechanism 10 will lock automatically. The two lock mechanisms 10, 12 remain under the protective covers and are tamper-resistant. The hitch-pins 62, 100 are not externally accessible once the lock mechanisms 10, 12 are engaged. Thus, the hitch-pins 62, 100 cannot be sawed off, and they lock automatically upon closing of the lid.

Additionally, it should be understood that the front and side lock mechanisms 10, 12 can be used with any swinging or pivoting doors or lids of tanks, containers, or boxes, and that those shown in the Figures are shown for exemplary purposes only. The front and side lock mechanisms 10, 12 may be cast from pig iron or similar materials and used in any type of swinging door system that must have considerable tamper-proof capability. Further, the front lock mechanism 10 can be manufactured and cast with any angle built into the base of the unit. This allows the locks to be used on containers that have hinge points that are of different distances from the lock mechanism. Additionally, the key lock tumblers 84, 116 can be keyed alike or differently with a master key, dependent upon the needs of the user.

In use, the customer may have access to the front lock mechanism 10, but is not able to access what is in the tank after the oil is stored therein, because only the personnel from the company will have access to both locks to remove the oil. Access to the reservoir 14 is performed by unlocking the front lock mechanism 10 with a master key and then unlocking the side lock mechanism 12 with a master key. The screen 16 is then pushed back or lifted, which allows the company personnel to remove the oil with the vacuum truck.

The front lock mechanism 10 will automatically lock when the lid 18 is closed in order to prevent tampering. The locking mechanisms 10, 12 can be welded into a box, pre-welded onto the side of a tank to prevent removal of the oil if the restaurant leaves the lid 18 open. The side lock mechanism 12 securing the screen 16 is unlocked with a master key and the hitch-pin 100 is removed manually through a hole in the rear of the security box.

It is to be understood that the present invention is not limited to the embodiment described above, but encompasses any and all embodiments within the scope of the following claims.

I claim:

1. A locking container, comprising:

a reservoir having a lower wall and at least one sidewall having an upper edge, said reservoir having an open interior region defined therein;

a raised, substantially C-shaped sidewall mounted on the upper edge of the at least one sidewall of said reservoir, said raised, substantially C-shaped sidewall defining an open front aligned with a front, upper edge of the at least one sidewall of said reservoir;

a lid pivotally secured to said raised, substantially C-shaped sidewall to selectively cover an open upper end and the open front thereof;

a screen removably received within said reservoir;

a side locking mechanism mounted to said raised, substantially C-shaped sidewall;

a hasp secured to said screen at one end thereof, a free end thereof being selectively and releasably locked to said side locking mechanism; and a front locking mechanism including a cover portion secured to a front edge of said lid, the cover portion defining an open interior region therein, a front hitch-pin being received therein, the front locking mechanism further including a front locking member secured to the at least one sidewall adjacent the front, upper edge thereof, the front locking member having a front passage formed therein for slidably receiving the front hitch-pin, the front locking member having a front lock for selectively and releasably engaging the front hitch-pin when the front hitch-pin is received within the front passage.

2. The locking container as recited in claim 1, wherein the front locking member of said front locking mechanism includes a front lock body having a front aperture formed therein, the aperture being positioned adjacent to, and communicating with, the front passage, the front lock being received within the front aperture.

3. The locking container as recited in claim 2, wherein a front face of the front lock body has an opening formed therein for receiving a locking pin, the locking pin further engaging a locking hole formed in the front lock.

4. The locking container as recited in claim 3, wherein the front lock body includes a pair of laterally opposed, beveled side edges.

5. The locking container as recited in claim 4, wherein the cover portion of the front locking mechanism includes a pair of laterally opposed, beveled side walls for cooperation with the pair of laterally opposed, beveled side edges of the front lock body when said lid is in a closed positioned.

6. The locking container as recited in claim 5, wherein said front hitch-pin includes a body portion and a head portion, an annular groove separating said body portion from said head portion.

7. The locking container as recited in claim 6, wherein said head portion is substantially conically shaped.

8. The locking container as recited in claim 1, wherein said side locking mechanism includes a cover secured to an exterior face of the raised, substantially C-shaped sidewall, the cover defining an open interior region therein for receiving a side locking member, the side locking member having a side passage formed therein for slidably receiving a side hitch-pin, the side hitch-pin engaging the side locking member and the free end of the hasp, the side locking member having a side lock for selectively and releasably engaging the side hitch-pin when the side hitch-pin is received within the side passage.

9. The locking container as recited in claim 8, wherein the side locking member has a side aperture formed therein, the side aperture being positioned adjacent to, and communicating with, the side passage, the side lock being received within the side aperture.

10. The locking container as recited in claim 9, wherein a side face of the side locking member has an opening formed therein for receiving a locking pin, the locking pin further engaging a locking hole formed in the side lock.

11. The locking container as recited in claim 10, wherein said side hitch-pin includes a body portion and a head portion, an annular groove separating said body portion from said head portion.

12. The locking container as recited in claim 11, wherein said head portion of said side hitch-pin is substantially conically shaped.

13. The locking container as recited in claim 12, further comprising a chain secured to said side hitch-pin and said reservoir.

14. A locking container, comprising:

a reservoir having a lower wall and at least one sidewall having an upper edge, said reservoir having an open interior region defined therein;

a raised, substantially C-shaped sidewall mounted on the upper edge of the at least one sidewall of said reservoir, said raised, substantially C-shaped sidewall defining an open front aligned with a front, upper edge of the at least one sidewall of said reservoir;

a lid pivotally secured to said raised, substantially C-shaped sidewall to selectively cover an open upper end and the open front thereof;

a screen removably received within said reservoir;

a side locking mechanism mounted to said raised, substantially C-shaped sidewall, said side locking mechanism including a cover secured to an exterior face of the raised, substantially C-shaped sidewall, the cover defining an open interior region therein for receiving a side locking member, the side locking member having a side passage formed therein for slidably receiving a side hitch-pin, the side locking member having a side lock for selectively and releasably engaging the side hitch-pin when the side hitch-pin is received within the side passage;

a hasp secured to said screen at one end thereof, a free end thereof being selectively and releasably locked to said side locking mechanism, the side hitch-pin engaging the side locking member and the free end of the hasp, and a front locking mechanism including a cover portion secured to a front edge of said lid, the cover portion-defining an open interior region therein, a front hitch-pin being received therein, the front locking mechanism further including a front locking member secured to the at least one sidewall adjacent the front, upper edge thereof, the front locking member having a front passage formed therein for slidably receiving the front hitch-pin, the front locking member having a front lock for selectively and releasably engaging the front hitch-pin when the front hitch-pin is received within the front passage.

15. The locking container as recited in claim 14, wherein the front locking member of said front locking mechanism includes a front lock body having a front aperture formed therein, the aperture being positioned adjacent to, and communicating with, the front passage, the front lock being received within the front aperture.

16. The locking container as recited in claim 15, wherein a front face of the front lock body has an opening formed therein for receiving a locking pin, the locking pin further engaging a locking hole formed in the front lock.

17. The locking container as recited in claim 16, wherein said front hitch-pin includes a body portion and a head portion, an annular groove separating said body portion from said head portion.

18. The locking container as recited in claim 17, wherein the side locking member has a side aperture formed therein, the side aperture being positioned adjacent to, and communicating with, the side passage, the side lock being received within the side aperture.

19. The locking container as recited in claim 18, wherein a side face of the side locking member has an opening formed therein for receiving a locking pin, the locking pin further engaging a locking hole formed in the side lock.

20. The locking container as recited in claim 19, wherein said side hitch-pin includes a body portion and a head portion, an annular groove separating said body portion from said head portion.

* * * * *